United States Patent [19]

Conley

[11] 4,249,760

[45] Feb. 10, 1981

[54] LATCH ASSEMBLY

[75] Inventor: James R. Conley, Wichita, Kans.

[73] Assignee: The Coleman Company, Inc., Wichita, Kans.

[21] Appl. No.: 1,184

[22] Filed: Jan. 5, 1979

[51] Int. Cl.[3] ..... E05C 3/10

[52] U.S. Cl. ..... 292/197; 292/83; 292/98

[58] Field of Search ..... 292/197, 83, 98, 124, 292/170

[56] References Cited

U.S. PATENT DOCUMENTS

| | | | |
|---|---|---|---|
| 251,367 | 12/1881 | King | 292/98 |
| 2,197,103 | 4/1940 | Gray | 292/83 |
| 3,690,708 | 9/1972 | Worley et al. | 292/DIG. 71 X |

FOREIGN PATENT DOCUMENTS

| | | | |
|---|---|---|---|
| 854226 | 11/1960 | United Kingdom | 292/98 |

*Primary Examiner*—Richard E. Moore

[57] ABSTRACT

A latch assembly for picnic coolers and the like includes a base, a latch, and an operating knob which is movably mounted on the base. The latch is pivotally supported by a fulcrum on the base, and the operating knob includes a pair of cams which pivot the latch between latched and unlatched positions.

15 Claims, 14 Drawing Figures

FIG. 1
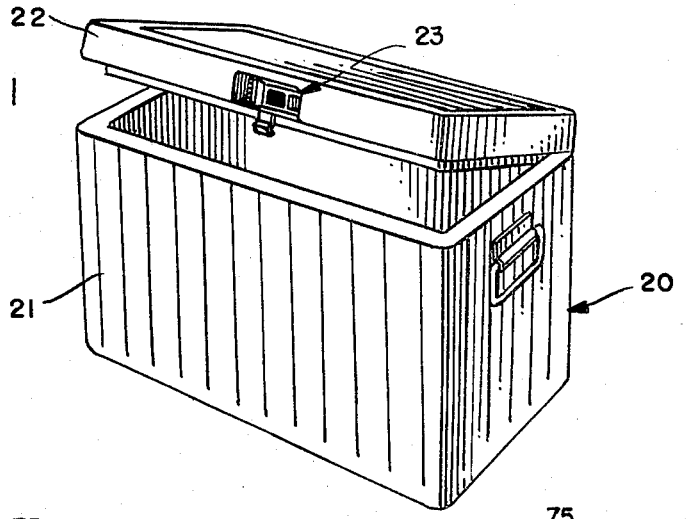
FIG. 2
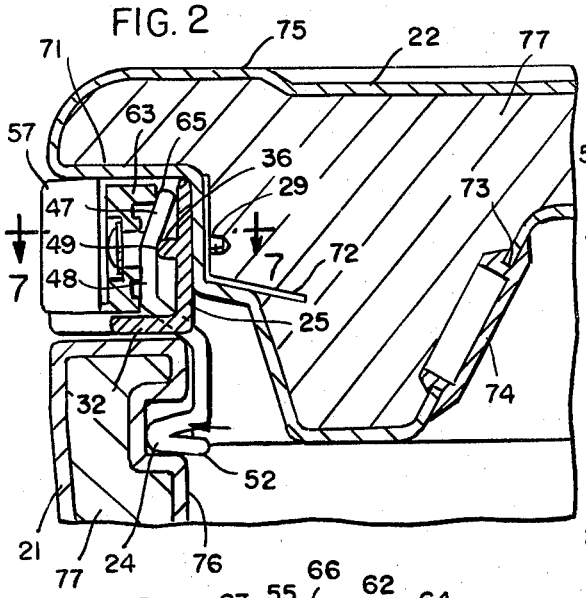
FIG. 3
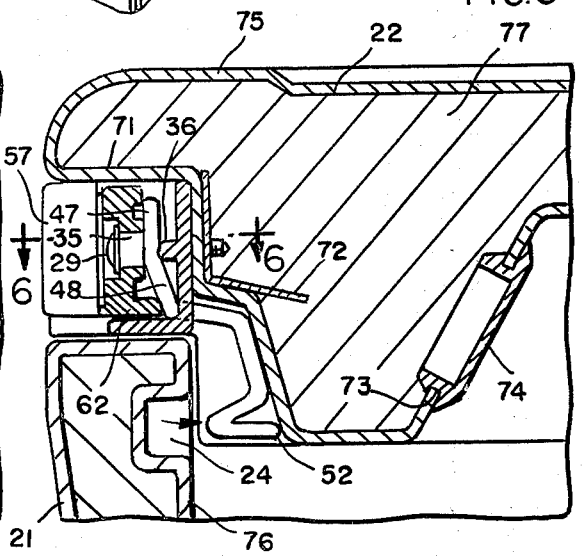
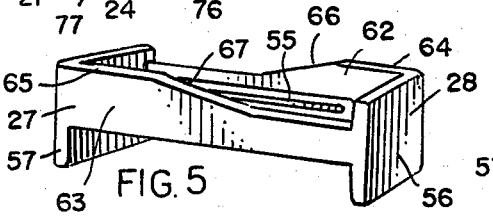
FIG. 5
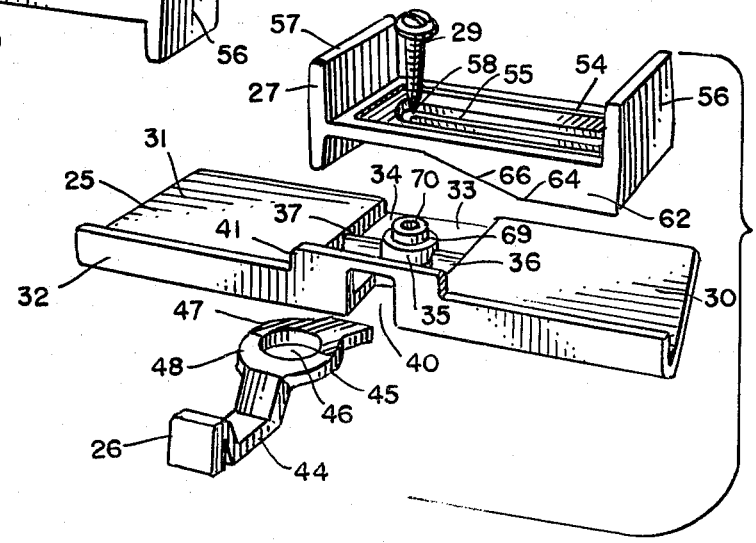
FIG. 4

LATCH ASSEMBLY

BACKGROUND AND SUMMARY

This invention relates to latch assemblies, and, more particularly, to a latch assembly in which the latch operates as a lever mounted on a fulcrum.

The latch assembly has particular utility with respect to containers, for example, picnic coolers, which include a cover or lid which is hingedly secured to a chest or container body. Such latch assemblies are desirably inexpensive, easy to assemble, and easy to operate, but they must also provide secure latching. Latches for picnic coolers must satisfy still another requirement—the latch must be releaseable to permit the cover to open when a certain force is applied to the cover. This safeguards against the possibility that a child could be trapped inside the cooler.

My latch assembly includes only three major parts which can be economically produced, for example, by molding from plastic, and which can be quickly assembled. The three parts are held together by a single screw, and the latch assembly operates on a fulcrum and lever principle to provide easy yet reliable operation. A latch is pivotally mounted on a fulcrum provided by a latch base, and an operating knob, which is movably attached to the base by the screw, includes cams for pivoting the latch on the fulcrum between latched and unlatched positions. The screw holds the knob in operative relationship to the base but the flexible and resilient latch can move out of latching engagement with the chest if a sufficient opening force is applied to the cover.

DESCRIPTION OF THE DRAWING

The invention will be explained in conjunction with an illustrative embodiment shown in the accompanying drawing, in which FIG. 1 is a perspective view of a picnic cooler equipped with a latch assembly formed in accordance with the invention;

FIG. 2 is an enlarged fragmentary sectional view showing the latch assembly latching the cover of the picnic cooler in a closed position;

FIG. 3 is a view similar to FIG. 2 showing the latch assembly in the unlatched position;

FIG. 4 is an exploded perspective view of the latch assembly;

FIG. 5 is a perspective view showing the rear side of the operating knob;

DESCRIPTION OF SPECIFIC EMBODIMENT

Figure 6:
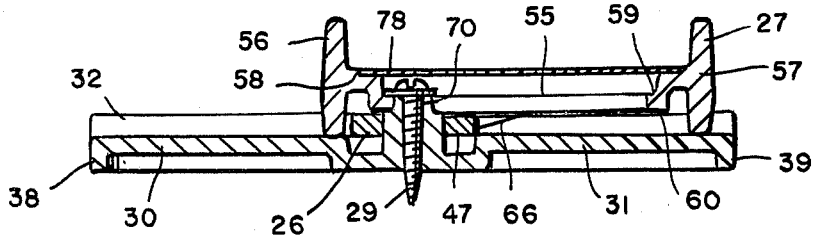
FIG. 6 is a sectional view taken along the line of 6—6 of FIG. 3 showing the latch assembly in its unlatched position.

The invention will be explained in conjunction with a picnic cooler 20 shown in FIG. 1. However, it will be understood that the latch assembly can be used in many other situations in which two members are to be releaseably latched together. The picnic cooler includes a container body 21 and a cover 22, which is hingedly secured to the body, the cover being shown in a partially open position in FIG. 1. A latch assemby 23 is mounted on the cover and cooperates with a recess 24 (FIGS. 2 and 3) in the body for latching the cover to the body.

Referring to FIG. 4, the latch assembly includes a latch base 25, which is adapted to be mounted on the cover of the picnic cooler, a latch 26, which is pivotally mounted on the base, and an operating knob 27, which is slidably connected to the base and which pivots the latch. The knob is connected to the base by screw 29. The base, latch, and knob can be advantageously injection molded from plastic, e.g., acetal.

Figure 11:
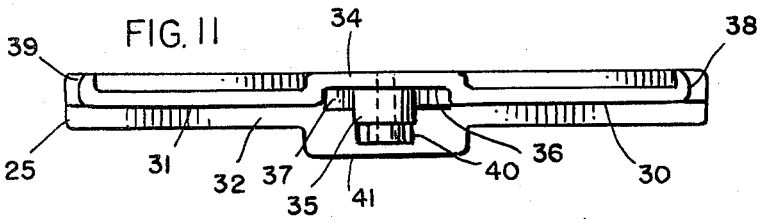
FIG. 11 is a top plan view of the latch base.
Figure 10:
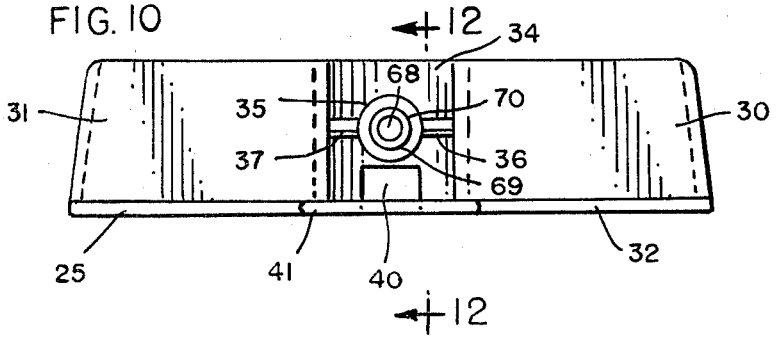
FIG. 10 is a front elevational view of the latch base.
Figure 12:
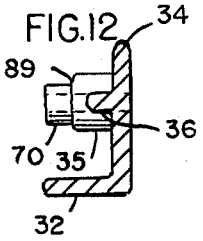
FIG. 12 is a sectional view taken along the line 12—12 of the FIG. 10.

The base is generally L-shaped in cross section (see also FIGS. 10–12) and includes a pair of flat slide surfaces 30 and 31 and a bottom supporting shelf 32 which extends perpendicularly from the slide surfaces. The two slide surfaces are joined in the center of the base by a fulcrum portion 33. The fulcrum portion includes a flat wall 34 which is offset rearwardly from the slide surfaces, a generally cylindrical bushing 35 which extends forwardly from the flat wall, and a pair of ribs 36 and 37 which extend radially from the bushing and parallel to the support shelf 32. The slide surfaces 30 and 31 terminate in rearwardly extending flanges 38 and 39 (FIG. 11), and the rear surfaces of the flanges, the back of the flat wall 34, and the rear edge of the support shelf 32 lie in the same plane to provide a supporting surface for the base. A latch opening 40 is provided through the center of the base at the intersection between the support shelf 32 and the flat wall 34 of the fulcrum portion. The central portion of the support shelf extends outwardly at 41 to reinforce the shelf in the area of the openings.

Figure 13:
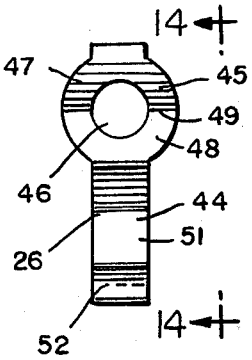
FIG. 13 is a front elevational view of the latch.
Figure 14:
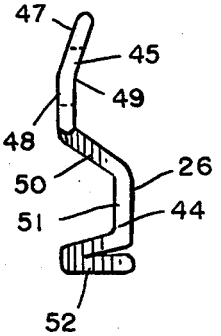
FIG. 14 is a side elevational view of the latch taken along the line 14—14 of FIG. 13.

The latch includes an elongated latching portion 44 (FIGS. 13 and 14) and a generally annular fulcrum portion 45. The fulcrum portion is provided with a circular opening 46, and the upper and lower halves 47 and 48 of the annulus form a generally V shape. The trough 49 of the V lies along a diameter of the opening, and in one specific embodiment the upper and lower halves formed an included angle of 160°. The longitudinal axis of the latching portion extends perpendicularly with respect to the trough 49, and the latching portion includes a first portion 50, an intermediate offset portion 51, and a V-shaped hook portion 52.

The width of the latching portion is slightly less than the width of the opening 40 in the base 25, and the latch is mounted on the base by inserting the hook end of the latch through the opening 40. The opening 46 in the fulcrum portion of the latch has a slightly larger diameter than the bushing 35 on the base 25, and the fulcrum portion is inserted over the bushing so that the groove 49 of the fulcrum portion engages the ribs 36 and 37.

Figure 7:
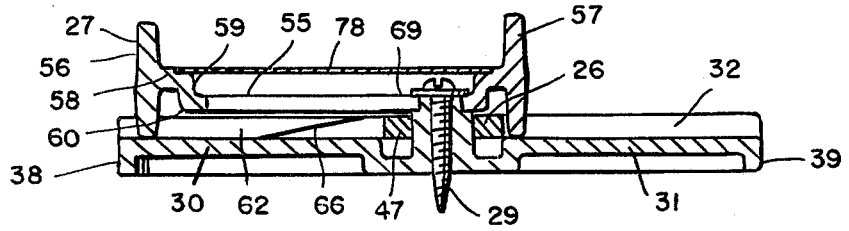
FIG. 7 is a sectional view taken along line 7—7 of FIG. 2 showing the latch assembly in its latched position.

The operating knob 28 includes an elongated central portion 54 (FIG. 4) which is provided with a longitudinally extending slot 55 and a pair of end flanges 56 and 57 which extend perpendicularly to the central portion. The flanges project forwardly beyond the front surface of the central portion to provide finger grips for sliding the knob in either direction. Referring to FIGS. 6 and 7, the periphery of the slot 55 is recessed in the front surface 58 of the central portion, and a rearwardly projecting flange 60 surrounds the rear of the slot.

A lower camming rib 62 projects rearwardly from the lower edge of the central portion of the knob between the end flange 56 and approximately the middle of the central portion. An upper camming rib 63 projects rearwardly from the upper edge of the knob between the end flange 57 and approximately the middle of the central portion. The camming ribs include flat rear surfaces 64 and 65, respectively, which lie in the same plane as the rear surfaces of the end flanges, and camming surfaces 66 and 67, respectively. The camming surfaces are inclined in generally opposite directions so that the lower camming surface 66 is operative to pivot the latch as the knob slides to the left as viewed in FIG. 4 and the upper camming surface 67 is operative as the knob slides to the right.

After the latch is mounted on the base as previously described, the knob 28 is positioned over the latch and the slide surfaces 30 and 31 of the base. The slot 55 in the knob extends parallel to the supporting shelf 32 of the base, and when the lower edge of the knob is supported by the shelf, the centerline of the slot will be aligned with the center of the bushing 35 on the base. The knob is connected to the base by the screw 29 which is inserted through the slot and the knob and through the central bore 68 (FIG. 10) of the bushing. The head of the screw engages the recessed periphery 59 of the slot, and the rear perimetric flange 60 around the slot engages an annular shoulder 69 on the bushing (see particularly FIGS. 7 and 12) which is provided by a radially reduced end portion 70 on the bushing. The diameter of the end portion 70 of the bushing is approximately the same as the width of the slot, and the end portion helps guide the sliding movement of the knob with respect to the base.

The assembled latch assembly is then inserted into a recess 71 (FIGS. 2 and 3) in the front of the cover of the picnic cooler, and the screw 29 is screwed into a metal backup plate 72, which holds the screw and reinforces the shell of the cover. The length of the end portion 70 of the bushing 35 is advantageously slightly greater than the thickness of the flange 60 around the slot and the knob so that the screw head can be tightened against the bushing without affecting the slidability of the knob with respect to the base. The cover is provided with an opening 73 through which the backup plate is held during the assembly, and the opening is thereafter closed by a plug 74. Both the cover and the body of the picnic cooler can be formed from plastic shells 75 and 76, respectively, which are filled with insulating foam 77. If desired, a label 78, (FIGS. 6 and 7) can be adhesively applied to the front surface 58 of the knob after the latch assembly is secured to the cover to conceal the screw and the slot. The label can be printed with arrows or the like, indicating the directions in which to slide the knob to latch and unlatch the cover.

When the latch assembly is assembled as described, the latch 27 is maintained between the base 25 and the operating knob 28. The annular fulcrum portion 45 of the latch is positioned over the large-diameter portion of the bushing 35, and the trough 49 (FIGS. 2 and 14) of the V-shaped fulcrum portion is held against the ribs 35 and 36 of the base. The ribs 35 and 36 act as fulcrums about which the latch pivots as the operating knob slides to the right and to the left with respect to the base.

Figure 8:
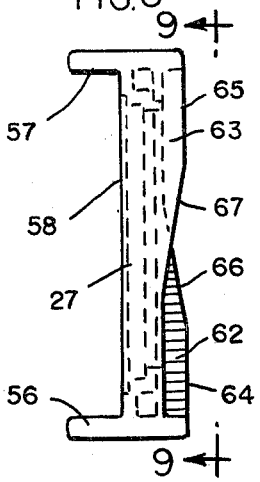
FIG. 8 is a top plan view of the operating knob.

The operating knob is shown in its right or latched position in FIGS. 2 and 7. The flat rear surface 65 of the upper camming rib 63 engages the upper half 47 of the V-shaped fulcrum portion of the latch and hold the latch in a position such that the hook 52 of the latch is maintained in the recess 24 in the body of the picnic cooler. As can be seen in FIG. 8, the lower camming rib 62 terminates to the right of the flat rear surface 56 of the upper camming rib 63, and the lower half 48 of the fulcrum portion of the latch extends substantially vertically downwardly from the fulcrum ribs 36 and 37 (FIG. 2).

When the operating knob is moved to the left from the latched position shown in FIGS. 2 and 7 toward the unlatched position shown in FIGS. 3 and 6, the camming surface 66 of the lower camming rib will engage the lower half 48 of the fulcrum portion of the latch and will pivot the latch counter clockwise as viewed in FIGS. 2 and 3 to withdraw the hook 52 of the latch from the recess 24. The operating knob provides controlled pivoting movement of the latch since as the lower camming surface 66 begins to engage the latch, the upper camming surface 67 begins to disappear (see particularly FIG. 8). When the flat rear surface 64 of the lower camming rib engages the latch, the upper camming rib has moved out of engagement with the latch, and the latch is held in its unlatched position. The configurations of the upper and lower camming ribs are correlated so that when the operating knob is between its latched and unlatched positions, both the upper and lower camming surfaces engage the latch to provide a continuous controlled pivoting movement.

Similarly, when the operating knob is moved from its unlatched position to its latched position, the camming surface 67 of the upper camming rib will engage the upper half 47 of the fulcrum portion of the latch and pivot the latch clockwise as viewed in FIGS. 2 and 3.

Figure 9:
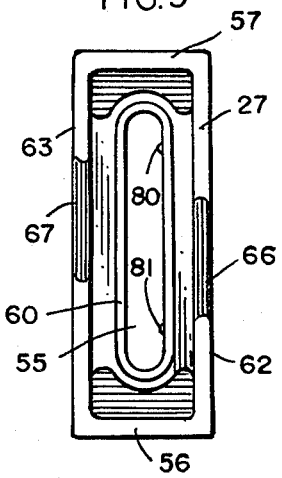
FIG. 9 is a rear elevational view of the operating knob taken along the line 9—9 of FIG. 8.

If desired, the periphery of the slot 55 of the operating knob can be provided with detents 80 and 81 (FIG. 9) which are engageable with the bushing 35 and which maintain the operating knob in its latched and unlatched positions, respectively, until a sufficient sliding force is applied to the knob to move the detent past the bushing.

The pivot axis of the latch lies along the ribs 36 and 37 of the base and extends parallel to the direction in which the operating knob slides. In the specific embodiment illustrated, the included angle between the upper and lower halves 47 and 48 of the fulcrum portion of the latch is 160°, and the latch pivots about 20° from the latched position of FIG. 2 in which the lower half 48 extends substantially vertically and the unlatched position of FIG. 3 in which the upper half 47 extends substantially vertically.

The flexibility of the latch permits it to be forced out of the recess 24 in the body of the picnic cooler if a sufficient opening force is applied to the cover even when the operating knob is in the latched position. Referring to FIG. 2, an upward or opening force on the cover 22 of the cooler will tend to cam the V-shaped hook 52 out of the recess 24. The flexibility of the latch is such that it will release the cover when an opening force of about 10 pounds is applied to the cover.

While the specific latch assembly described utilizes a sliding operating knob, it will be understood that the fulcrum and lever type of operation of the latch can be obtained by different operating means. For example, a rotary knob could be rotatably attached to the base so that rotation of the knob brought cam surfaces on the knob into engagement with the upper and lower halves of the fulcrum portion of the latch.

The three moving parts of the latch assembly can be molded from plastic, and the only metal part is the screw 29, which can be made from non-corrosive metal. Accordingly, the latch assembly is particularly suitable for use with all-plastic rustproof picnic coolers. However, even though the parts of the latch assembly are molded from plastic, the latch assembly provides safe, reliable operation.

While in the foregoing specification, a detailed description of a specific embodiment of the invention was described for the purpose of illustration, it will be understood that many of the details hereingiven may be varied considerably by those skilled in the art without departing from the spirit and scope of the invention.

I claim:

1. A latch assembly comprising a base, a knob movably mounted on the base for movement between a latched position and an unlatched position, a latch pivotally mounted between the base and the knob, the base including a fulcrum which engages the latch and about which the latch is pivotable, the latch having a generally V-shaped fulcrum portion which includes a trough portion which engages said fulcrum and a pair of cam-engaging portions which diverge from the trough portion, and cam means on the knob engageable with the latch for pivoting the latch into a latched position when the knob moves to its latched position and for pivoting the latch into an unlatched position when the knob moves to its unlatched position, said cam means including a first cam which is engageable with one of said cam-engaging portions of the latch when the knob moves to its latched position and a second cam which is engageable when the other of said cam-engaging portions of the latch when the knob moves to its unlatch position.

2. A latch assembly comprising a base, a knob slidably mounted on the base for sliding movement between a latched position and an unlatched position, the knob having an elongated slot which extends in the direction of sliding movement, a latch pivotally mounted between the base and the knob, the base including a fulcrum which engages the latch and about which the latch is pivotable, and cam means on the knob engageable with the latch for pivoting the latch into a latched position when the knob moves to its latched position and for pivoting the latch into an unlatched position when the knob moves to its unlatched position, the latch and the base being providing with openings which are aligned with the elongated slot in the knob, and fastener means extending through the slot and the aligned openings for holding the knob, latch and base together.

3. A latch assembly comprising a base, a knob movably mounted on the base for movement between a latched position and an unlatched position, a latch pivotally mounted between the base and the knob, the base including a fulcrum which engages the latch and about which the latch is pivotable, and cam means on the knob engageable with the latch for pivoting the latch into a latched position when the knob moves to its latched position and for pivoting the latch into an unlatched position when the knob moves to its unlatched position, the latch including a flexible latching portion which can be flexed out of its latched position when the cam means engages the latch in the latched position.

4. A latch assembly comprising a base, a knob slidably mounted on the base for movement between a latched position and an unlatched position, a latch pivotally mounted between the base and the knob for pivoting movement about an axis which extends parallel to the direction of sliding movement of the knob, the base including a fulcrum which engages the latch and about which the latch is pivotable, and a pair of cam surfaces on the knob which are spaced apart on opposite sides of said pivot axis and which extend generally parallel to said pivot axis, one of the cam surfaces being engageable with the latch when the knob slides to its latched position for pivoting the latch about said pivot axis to its latched position and the other cam surface being engageable with the latch when the knob slides to its unlatched position for pivoting the latch about said pivot axis to its unlatched position.

5. A latch assembly for a picnic cooler having a chest and a cover hingedly attached to the chest, the latch assembly comprising a base secured to the cover, a knob movably mounted on the base for movement between a latched position and an unlatched position, a latch pivotally mounted between the base and the knob and including a pivot portion, a hook portion, and an intermediate portion connecting the hook portion and the pivot portion, the base including a fulcrum which engages the pivot portion of the latch and about which the latch is pivotable, and cam means on the knob engageable with the pivot portion of the latch for pivoting the latch into a latched position in which the hook portion is positioned in a recess in the chest when the knob moves to its latched position and for pivoting the latch into an unlatched position in which the hook portion is out of the recess in the chest when the knob moves to its unlatched position.

6. The latch assembly of claim 5 in which the intermediate portion is flexible to permit the hook portion to be forced out of the recess in the chest when the latch is in its latched position when an opening force of about 10 pounds is exerted on the cover.

7. The latch assembly of claim 1 in which the knob is mounted on the base for sliding movement between its latched position and its unlatched position.

8. The latch assembly of claim 4 in which said fulcrum includes a rib on said base which extends generally parallel to said pivot axis.

9. The structure of claim 4 in which said fulcrum includes a rib on said base which extends generally parallel to said pivot axis, the latch having a generally V-shaped fulcrum portion which includes a trough portion which engages said rib and a pair of cam-engaging portions which diverge from the trough portion, one of said cam-engaging portions being engageable with one of said cam surfaces and the other of said cam-engaging portions being engageable with the other of said cam surfaces.

10. The latch assembly of claim 4 in which said knob is provided with an elongated slot between said cam surfaces which extends parallel to the direction of sliding movement of the knob and said base is provided with an opening having a center which is generally aligned with the center of the slot in the knob, and holding means extending through said slot in the knob and said opening in the base for holding the base, the latch, and the knob together.

11. The latch assembly of claim 10 in which said base includes a bushing which extends through said opening in the latch and through said slot in the knob.

12. The latch assembly of claim 11 in which said bushing includes a flat surface which engages the knob on opposite sides of said slot for slidably supporting the knob.

13. The latch assembly of claim 11 in which said fulcrum includes a rib which extends generally parallel to the direction of sliding movement of the knob on opposite sides of the bushing.

14. The latch assembly of claim 13 in which said latch has a generally V-shaped pivot portion which includes a trough portion which engages said rib and a pair of cam-engaging portions which diverge from the trough portion.

15. A latch assembly comprising a base, a knob movably mounted on the base for movement between a latched position and an unlatched position, a latch pivotally mounted between the base and the knob, the base including a fulcrum which engages the latch and about which the latch is pivotable, and cam means on the knob engageable with the latch for pivoting the latch into a latched position when the knob moves to its latched position and for pivoting the latch into an unlatched position when the knob moves to its unlatched position, said knob being mounted on the base for sliding movement between its latched position and its unlatched position, the knob being slidable in a direction generally parallel to the axis about which the latch pivots, said cam means including a pair of cam surfaces on the knob which are spaced apart on opposite sides of said pivot axis and which extend generally parallel to said pivot axis, one of the cam surfaces being engageable with the latch when the knob slides to its latched position for pivoting the latch about said pivot axis to its latched position and the other cam surface being engageable with the latch when the knob slides to its unlatched position for pivoting the latch about said pivot axis to its unlatched position in which the latch includes a pivot portion engaging said fulcrum, a hook portion adapted to be received in a latching recess when the latch is in its latched position, and an intermediate portion connecting the hook portion and the pivot portion, the intermediate portion being flexible to permit the hook to be forced out of the recess when the latch is in its latched position.

* * * * *